US010641444B2

(12) United States Patent
Cao

(10) Patent No.: US 10,641,444 B2
(45) Date of Patent: May 5, 2020

(54) SMT LED LIGHT STRING WHICH CONTROL CHIP IS EMBEDDED IN LIGHT BEAD

(71) Applicant: Lin-Yu Cao, Guangdong (CN)

(72) Inventor: Lin-Yu Cao, Guangdong (CN)

( * ) Notice: Subject to any disclaimer, the term of this patent is extended or adjusted under 35 U.S.C. 154(b) by 2 days.

(21) Appl. No.: 15/865,274

(22) Filed: Jan. 9, 2018

(65) Prior Publication Data

US 2019/0211979 A1 Jul. 11, 2019

(51) Int. Cl.
*H05B 45/00* (2020.01)
*F21S 4/10* (2016.01)
*F21V 23/00* (2015.01)

(52) U.S. Cl.
CPC ..... *F21S 4/10* (2016.01); *F21V 23/001* (2013.01); *H05B 45/00* (2020.01)

(58) Field of Classification Search
CPC ..... F21S 4/28; F21S 4/24; F21S 4/10; H05B 33/0842
See application file for complete search history.

(56) References Cited

U.S. PATENT DOCUMENTS 4,675,575 A * 6/1987 Smith ..... F21S 4/10 250/552
5,008,595 A * 4/1991 Kazar ..... H05B 33/0803 315/178
5,988,831 A * 11/1999 Pan ..... H05B 39/00 315/185 R
7,728,216 B2 * 6/2010 Hermanson ..... A63J 17/00 84/464 A
8,052,303 B2 * 11/2011 Lo ..... F21V 5/00 315/185 R
8,207,541 B2 * 6/2012 Van Herpen ..... B32B 17/10036 257/88
8,229,719 B2 * 7/2012 Zhang ..... G06F 17/5018 703/2
8,471,480 B2 * 6/2013 Kinderman ..... H05B 37/029 315/185 R
8,760,061 B2 * 6/2014 Peng ..... H05B 33/0821 315/185 R
8,791,650 B2 * 7/2014 Shan ..... H05B 33/0803 315/185 S
9,510,406 B2 * 11/2016 McRae ..... H05B 37/0272
9,516,706 B2 * 12/2016 Shan ..... B60Q 3/43
9,693,406 B2 * 6/2017 Kim ..... H05B 33/083
9,781,806 B1 * 10/2017 Yeh ..... H05B 33/0827
10,288,235 B1 * 5/2019 Chen ..... H01L 27/153
(Continued)

*Primary Examiner* — Anabel Ton
(74) *Attorney, Agent, or Firm* — Leong C. Lei

(57) ABSTRACT

A SMT LED light string which the ICs with IDs are embedded in the light beads; wherein the light string is formed by connecting a plurality of SMT LED light beads which the IC control chips with IDs are set inside. All of the corresponding IC control chips with IDs for the SMT LED light beads can be controlled because the IC control chips with IDs are set in the SMT LED light beads. Therefore, the stable and orderly flashing can be achieved, and the lighting effects such as the line-up, the progression, and the chasing . . . , etc. can also be made. No matter for a monochrome light string or a colored light string, the effective control can both be achieved to make the various lighting effects because the IC control chips with IDs are set in the SMT LED light beads.

3 Claims, 1 Drawing Sheet

(56) References Cited

U.S. PATENT DOCUMENTS

| | | | | |
|---|---|---|---|---|
| 2015/0219285 | A1* | 8/2015 | Rantala | H01L 25/0753<br>362/249.02 |
| 2018/0156407 | A1* | 6/2018 | Lee | H05B 33/0803 |
| 2019/0239308 | A1* | 8/2019 | Lee | F21V 23/007 |

* cited by examiner

SMT LED LIGHT STRING WHICH CONTROL CHIP IS EMBEDDED IN LIGHT BEAD

TECHNICAL FIELD OF THE INVENTION

The present invention is used in the field of all decorative SMT light strings, and is specifically related to a decorative SMT LED light string including the copper line light, soft line light, PVC line light, tube light, string light, shoe light, cloth light, and other kind of decorative light.

DESCRIPTION OF THE PRIOR ART

The existing decorative light string is divided into two kinds of monochrome and color. The circuit loop of the monochrome light string is simple, and it has stable flashing. However, it just has single color without the ability to change color, therefore it is difficult to meet the color requirement of some users.

Generally, the color light string is formed by setting the light-emitting chips with the three primary colors, red, green and blue inside the SMT LED light beads, which can emit different colors of light to meet the color requirement of some users.

However, there must be more than three lines or more for the circuit loops of the color light string, and it is difficult to control the stable and orderly flashing of the light beads by the control IC connected in series in front of the light beads and difficult to realize the light effects of line-up, progression, and chasing.

SUMMARY OF THE INVENTION

In order to solve the aforementioned technical problems, an object of the present invention is to provide a SMT (RGB) LED light string; wherein the ICs with IDs are embedded in the RGB LED light beads.

The stable and orderly flashing can be controlled through the IC control chips in the SMT LED light beads, and the lighting effects such as the line-up, the progression, and the chasing . . . , etc. can also be made.

The technical solution of the present invention is described as follows.

A SMT LED light string which the ICs with IDs are embedded in the light beads; wherein the light string is formed by connecting a plurality of SMT LED light beads which the IC control chips with IDs are set inside.

As a further improvement of the above technical solution, the SMT (RGB) LED light string (1) is formed by connecting a plurality of SMT LED light beads (2) with IDs, and the IDs may be formed by a ID composition of three, four, five, . . . N.

As a further improvement of the above technical solution, the connection type of the SMT LED light beads can be serial connection, parallel connection, or serial-parallel connection.

The beneficial effects of the present invention are described as follows.

All of the corresponding IC control chips with IDs for the SMT LED light beads can be controlled because the IC control chips with IDs are set in the SMT LED light beads of the present invention. Therefore, the stable and orderly flashing can be achieved, and the lighting effects such as the line-up, the progression, and the chasing . . . , etc. can also be made.

No matter for a monochrome light string or a colored light string, the effective control can both be achieved to make the various lighting effects and the circuit loop of the colored light string can also be simplified because the IC control chips with IDs are set in the SMT LED light beads.

DETAILED DESCRIPTION OF THE PREFERRED EMBODIMENTS

The following descriptions are exemplary embodiments only, and are not intended to limit the scope, applicability or configuration of the invention in any way. Rather, the following detailed description provides a convenient illustration for implementing exemplary embodiments of the invention. Various changes to the described embodiments may be made in the function and arrangement of the elements described without departing from the scope of the invention as set forth in the appended claims.

Figure 1:
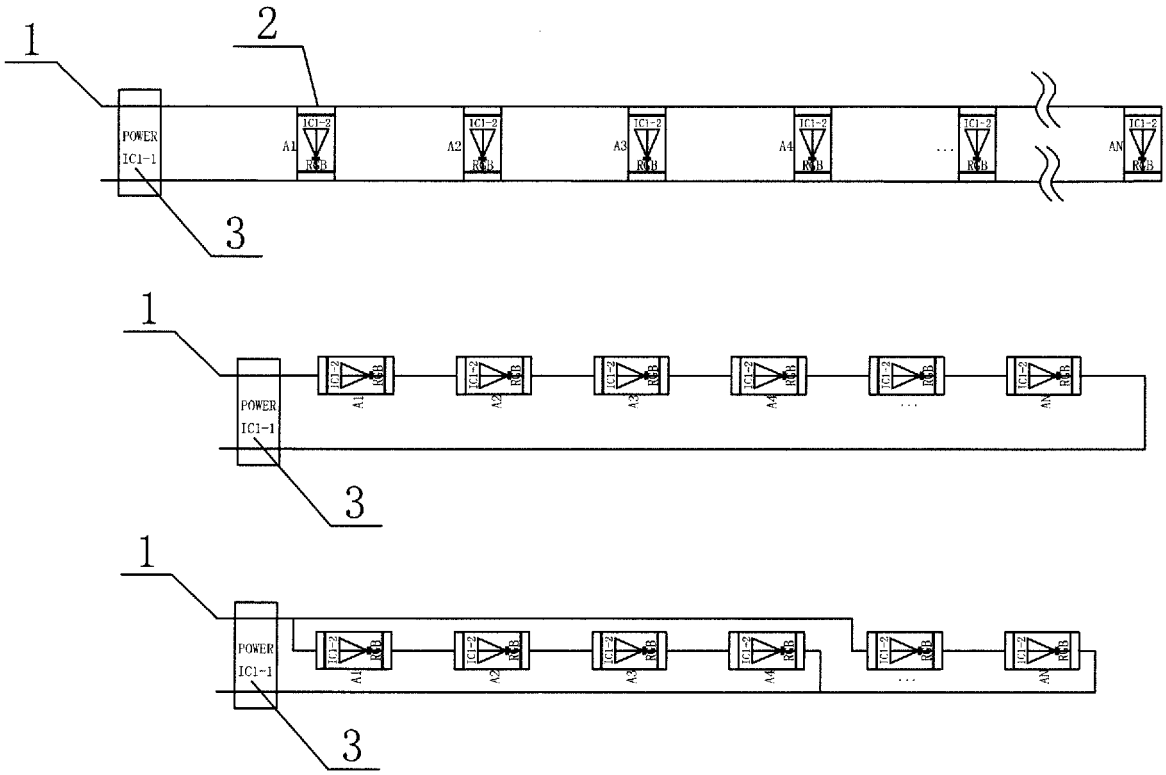
FIG. 1 is a structure schematic diagram of the SMT LED light string according to the present invention.
Figure 2:
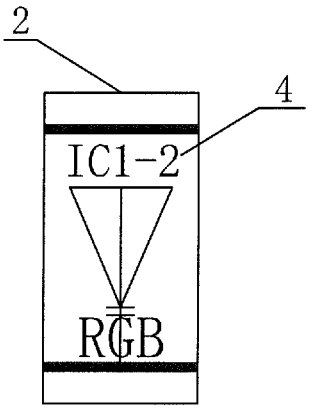
FIG. 2 is a structure schematic diagram of the SMT LED light bead according to the present invention.

The present invention provides a SMT LED light string 1, wherein the control chips are embedded in the light beads. Please refer to FIG. 1 and FIG. 2, the light string 1 is formed by connecting a plurality of SMT LED light beads 2.

The connection type of the SMT LED light beads 2 can be serial connection, parallel connection, or serial-parallel connection.

A control IC 3 is connected serially in front of the light string 1, and a plurality of control chips 4 are respectively set in each of the SMT LED light beads 2.

The various lighting effects can be made together by the mutual cooperation of the control chip 4 and the control IC 3 because the control chips are set in the SMT LED light beads 2.

No matter for a monochrome light string 1 or a colored light string 1, the effective control can both be achieved, such as the lighting effects of the stable and orderly flashing, the line-up, the progression, and the chasing . . . , etc.

Besides, the circuit loop of the colored light string can be simplified to reduce the wiring and save the cost because the control chip 4 is adopted to control the color change in the SMT LED light beads 2.

I claim:

1. A SMT (RGB) LED light string, wherein a light string is formed by connecting three or more SMT LED light beads with IDs, wherein the IDs that are set in the SMT LED light beads as orderly arranged identifications; wherein an RGB light source and a control chip are both set in each of the SMT LED light beads to form an LED light;

wherein the SMT LED light beads are connected together to form the light string and each of the SMT LED light beads includes a control chip embedded therein; and wherein a control IC is connected serially in front of the light string to pair with the control chips of the SMT LED light beads to control lighting of the SMT LED light beads, wherein each of the SMT LED light beads of the light string is controlled through cooperation of the control IC that is connected serially in front of the light string and the control chip of said each of the SMT LED light beads so that the RGB light source of said each of the SMT LED light beads is controlled by both the control IC and the control chip.

2. The SMT (RGB) LED light string according to claim 1, wherein the light string is formed by connecting a plurality of SMT LED light beads with IDs, and the IDs are formed by a ID composition of three, four, five, . . . N.

3. The SMT (RGB) LED light string according to claim 1, wherein the connection of the SMT LED light beads is serial connection, parallel connection, or serial-parallel connection.

* * * * *